US006079244A

United States Patent [19]

Robinson et al.

[11] Patent Number: 6,079,244

[45] **Date of Patent: *Jun. 27, 2000**

[54] METHOD AND APPARATUS FOR RESHAPING A CONTAINER BODY

[75] Inventors: Greg Robinson, Louisville; Otis Willoughby, Boulder; Howard Curtis Chasteen, Golden, all of Colo.

[73] Assignee: Ball Corporation, Broomfield, Colo.

[ * ] Notice: This patent is subject to a terminal disclaimer.

[21] Appl. No.: 09/158,744

[22] Filed: Sep. 22, 1998

Related U.S. Application Data

[63] Continuation-in-part of application No. 08/582,866, Jan. 4, 1996, Pat. No. 5,916,317.

[51] Int. Cl.[7] ..... B21D 26/02; B21D 39/08

[52] U.S. Cl. ..... 72/61; 72/56; 29/421.1

[58] Field of Search ..... 72/54, 56, 61, 72/62, 63; 29/421.1

[56] References Cited

U.S. PATENT DOCUMENTS

| | | | |
|---|---|---|---|
| 10,934 | 5/1854 | Hobson . | |
| Re. 24,833 | 5/1960 | Peccerill | 113/44 |
| 392,977 | 11/1888 | Langerfeld . | |
| 429,349 | 6/1890 | Hobson et al. . | |
| 464,736 | 12/1891 | Stapley . | |
| 464,737 | 12/1891 | Stapley . | |
| 701,550 | 6/1902 | Deering . | |
| 1,310,118 | 7/1919 | Greenfield et al. . | |
| 1,448,457 | 3/1923 | Liddell . | |
| 1,711,445 | 4/1929 | Burvenick . | |
| 1,727,198 | 9/1929 | Ziegler . | |
| 1,766,098 | 6/1930 | Booth . | |
| 1,847,794 | 3/1932 | Takeda . | |
| 1,919,869 | 7/1933 | Stanitz et al. . | |
| 1,951,381 | 3/1934 | Ward | 153/73 |
| 2,032,020 | 2/1936 | Koether | 153/10 |
| 2,041,355 | 5/1936 | Koether | 153/10 |
| 2,050,227 | 8/1936 | Mantle | 152/73 |
| 2,354,564 | 7/1944 | Wiley | 18/45 |
| 2,407,855 | 9/1946 | Stephens | 113/44 |
| 2,426,949 | 9/1947 | Puster | 153/73 |
| 2,592,867 | 4/1952 | Cuq | 113/44 |
| 2,649,067 | 8/1953 | Kranenberg | 113/44 |
| 2,742,873 | 4/1956 | Moore | 113/44 |
| 2,743,691 | 5/1956 | Cuq | 113/44 |
| 2,787,973 | 4/1957 | Heidmann | 113/44 |
| 2,966,872 | 1/1961 | Schmocker | 113/44 |
| 3,094,091 | 6/1963 | Peccerill | 113/44 |
| 3,220,235 | 11/1965 | Peccerill | 72/62 |

(List continued on next page.)

FOREIGN PATENT DOCUMENTS

| | | |
|---|---|---|
| 94344 | 4/1983 | European Pat. Off. . |
| 2047455 | 9/1970 | Germany . |
| 145504 | 8/1979 | Germany . |
| 22138 | 10/1939 | Japan . |
| 4934 | 2/1972 | Japan . |
| 54223 | 4/1980 | Japan . |
| 57-88919 | 6/1982 | Japan . |
| 76628 | 10/1982 | Japan . |
| 82228 | 5/1985 | Japan . |
| 214830 | 9/1987 | Japan . |
| 1692302 | 5/1990 | Russian Federation . |
| 442124 | 10/1934 | United Kingdom . |
| 1 332 461 | 10/1973 | United Kingdom . |
| 2 224 965 | 10/1989 | United Kingdom . |
| WO 97/35676 | 10/1997 | WIPO . |

*Primary Examiner*—David Jones
*Attorney, Agent, or Firm*—Sheridan Ross P.C.

[57] ABSTRACT

A method and apparatus for reshaping a container body (e.g., a metal, drawn and ironed container body) utilizing a floating mechanism for imparting an axial load is disclosed. In one embodiment, a container may have a substantially cylindrical sidewall with an inner surface and outer surface, where a shape defining means has a contoured surface positionable with respect to a container sidewall.

When a floating mechanism imparts an axial load, a fluid seal is maintained allowing sidewall deformation by means of a directed pressurized fluid.

25 Claims, 5 Drawing Sheets

U.S. PATENT DOCUMENTS

| | | | |
|---|---|---|---|
| 3,222,902 | 12/1965 | Brejcha et al. | 72/56 |
| 3,224,239 | 12/1965 | Hansson | 72/62 |
| 3,228,222 | 1/1966 | Maier | 72/56 |
| 3,236,080 | 2/1966 | Illgen | 72/56 |
| 3,252,312 | 5/1966 | Maier | 72/56 |
| 3,256,846 | 6/1966 | Keinanen | 113/120 |
| 3,320,784 | 5/1967 | Heeren et al. | 72/56 |
| 3,376,723 | 4/1968 | Chelminski | 72/56 |
| 3,383,890 | 5/1968 | Wildi | 72/56 |
| 3,420,079 | 1/1969 | Erlandson | 72/56 |
| 3,459,028 | 8/1969 | Bijovoet | 72/393 |
| 3,461,699 | 8/1969 | Roth | 72/56 |
| 3,485,073 | 12/1969 | Burney | 72/53 |
| 3,526,020 | 9/1970 | Lemelson | 18/14 |
| 3,555,866 | 1/1971 | Roth | 72/56 |
| 3,556,032 | 1/1971 | Fraze | 113/120 |
| 3,557,590 | 1/1971 | Erlandson | 72/56 |
| 3,559,434 | 2/1971 | Keinanen | 72/56 |
| 3,559,435 | 2/1971 | Gerber | 72/56 |
| 3,566,647 | 3/1971 | Inoue | 72/56 |
| 3,566,648 | 3/1971 | Norin et al. | 72/56 |
| 3,572,073 | 3/1971 | Dean et al. | 72/62 |
| 3,572,271 | 3/1971 | Fraze | 133/120 |
| 3,593,551 | 7/1971 | Roth et al. | 72/56 |
| 3,599,461 | 8/1971 | Astl | 72/56 |
| 3,613,423 | 10/1971 | Nakamura | 72/58 |
| 3,631,699 | 1/1972 | Roth | 72/56 |
| 3,688,535 | 9/1972 | Keinanen et al. | 72/56 |
| 3,698,221 | 10/1972 | Couland | 72/62 |
| 3,698,337 | 10/1972 | Brawner et al. | 113/120 |
| 3,736,846 | 6/1973 | Frankenberg | 93/82 |
| 3,742,746 | 7/1973 | Erlandson | 72/56 |
| 3,757,555 | 9/1973 | Blutt et al. | 72/63 |
| 3,774,559 | 11/1973 | Kindelvich et al. | 113/1 G |
| 3,797,294 | 3/1974 | Roth | 72/56 |
| 3,800,578 | 4/1974 | Brennan et al. | 72/56 |
| 3,807,209 | 4/1974 | Aschberger et al. | 72/63 |
| 3,810,372 | 5/1974 | Queyrolx | 72/56 |
| 3,810,373 | 5/1974 | Queyroix | 72/56 |
| 3,842,631 | 10/1974 | Aschberger et al. | 72/63 |
| 3,857,265 | 12/1974 | Howeler et al. | 72/56 |
| 3,858,422 | 1/1975 | Tominaga et al. | 72/56 |
| 3,919,871 | 11/1975 | Andrasev et al. | 72/55 |
| 3,953,994 | 5/1976 | Brawner et al. | 72/58 |
| 3,974,675 | 8/1976 | Tominaga | 72/56 |
| 4,265,102 | 5/1981 | Shimakata et al. | 72/58 |
| 4,282,734 | 8/1981 | Eddy | 72/54 |
| 4,320,644 | 3/1982 | Fischer | 72/75 |
| 4,354,371 | 10/1982 | Johnson | 72/53 |
| 4,392,292 | 7/1983 | Irons | 29/421 |
| 4,455,852 | 6/1984 | Paton et al. | 72/82 |
| 4,513,497 | 4/1985 | Finch | 29/727 |
| 4,557,128 | 12/1985 | Costabile | 72/6 |
| 4,619,129 | 10/1986 | Petkov et al. | 72/56 |
| 4,723,430 | 2/1988 | Hahn | 72/54 |
| 4,788,843 | 12/1988 | Seaman et al. | 72/58 |
| 4,791,796 | 12/1988 | Ford | 72/62 |
| 4,827,605 | 5/1989 | Krips et al. | 29/727 |
| 4,901,557 | 2/1990 | Schmidt | 72/370 |
| 4,928,509 | 5/1990 | Nakamura | 72/61 |
| 4,947,667 | 8/1990 | Gunkel et al. | 72/56 |
| 4,989,434 | 2/1991 | Brossia et al. | 72/82 |
| 5,022,135 | 6/1991 | Miller et al. | 29/421.1 |
| 5,022,254 | 6/1991 | Kramer | 72/393 |
| 5,040,682 | 8/1991 | Palisin, Jr. et al. | 206/519 |
| 5,048,408 | 9/1991 | Leftault, Jr. et al. | 72/56 |
| 5,115,654 | 5/1992 | Swars et al. | 72/62 |
| 5,160,031 | 11/1992 | Palisin, Jr. et al. | 206/519 |
| 5,187,962 | 2/1993 | Bilko et al. | 72/62 |
| 5,261,261 | 11/1993 | Ramsey | 72/105 |
| 5,275,033 | 1/1994 | Riviere | 72/62 |
| 5,293,765 | 3/1994 | Nussbaum-Pogacnik | 72/42 |
| 5,339,666 | 8/1994 | Suzuki et al. | 72/56 |
| 5,349,837 | 9/1994 | Halasz | 72/94 |
| 5,353,617 | 10/1994 | Cherian et al. | 72/56 |
| 5,357,774 | 10/1994 | Klages et al. | 72/62 |
| 5,372,028 | 12/1994 | Brilman et al. | 72/117 |
| 5,419,171 | 5/1995 | Bumgarner | 72/62 |
| 5,524,466 | 6/1996 | Coe | 72/62 |
| 5,794,474 | 8/1998 | Willoughby et al. | 72/61 |
| 5,916,317 | 6/1999 | Willoughby et al. | 72/61 |

METHOD AND APPARATUS FOR RESHAPING A CONTAINER BODY

This patent application is a continuation in part of the U.S. patent application Ser. No. 08/582,866, filed Jan. 4, 1996, now U.S. Pat. No. 5,916,317, incorporated herein by reference.

The present invention generally relates to reshaping container bodies and, more particularly, to utilizing one or more pressurized streams for container body reshaping operations while the container is under axial load.

BACKGROUND INFORMATION

Numerous techniques have been employed for forming thin-walled work pieces, including in particular, longitudinal welding and drawing/redrawing/ironing techniques used in forming three-piece and two-piece cylindrical metal container bodies, respectively. Subsequent modifications to metal container bodies can be achieved via die necking, roll or spin necking, and other secondary processes.

With regard to further shaping operations, recently symmetric longitudinal flutes or ribs, and diamond, waffle and numerous other patterns have been imparted to cylindrical container bodies through the use of either an internal roller and an external compliant mat, or by an internal roller and a matching external rigid forming element. Expanding mandrels have also been utilized on three-piece metal container bodies to impart such patterns. Applying an axial load on the end of a cylinder as it is radially expanded is a common method of assisting in the expansion. Those of skill in the art understand "shaping" (or "reshaping") to include not only forming or changing a general contour, outline, section, or the like, but to also include a number of other items such as, e.g., embossing (or debossing), texturizing and the like.

The noted techniques are limited as to the diametric extent and complexity of shaping that can be achieved. By way of example, die-necking cannot readily be employed for current aluminum drawn and ironed beverage containers (e.g., containers having a sidewall thickness of about 4–7 mil.) to achieve diametric changes of more than about 3% in any single operation, and does not generally allow for container diameters to be increased then decreased (or vice-versa) or for discontinuous/angled designs to be shaped along the longitudinal extent of a container body. While spin forming techniques have been found to allow for relatively high degrees of expansion (e.g., in excess of 15% for current aluminum drawn and ironed beverage containers), relative rotation between a container body and the forming roller is necessary, thereby restricting the ability to achieve non-circular cross-sections along the longitudinal extent of a container body.

Other proposed techniques also have limitations. For example, electromagnetic and hydrostatic processes have been considered which entail the use of magnetic fields and pressurized vessels, respectively, by themselves, to force a container body sidewall outward against an outer shaping die. Both processes require, however, a container body to be of sufficient ductility to withstand substantial attendant plastic deformation without failure. For current drawn and ironed aluminum beverage containers, such deformation limits are believed to be less than 3% (and generally less than 2%) before failure is realized due to the limited ductility of the aluminum alloys utilized. While annealing such container bodies may provide sufficient ductility to allow a greater degree of metal deformation, it would lower the strength of container bodies and require additional undesirable thermal processing.

INVENTION SUMMARY

In one embodiment, a container reshaping process may involve local working using a pressurized stream while placing the container under axial load such as pressing a preferably floating support against a container flange. Axial load may be accomplished using a spring assembly consisting of a spring located between a spring top cap and a lower body such as an air pressurization chamber body. In one configuration, a spring assembly rests against a floating support. The spring assembly may provide an axial load, in one condition, of between about 5 and about 100 pounds force, but preferably between about 10 and about 40 pounds of force. The axial load seals an interface between a floating seal ring and a container flange. In one embodiment, an axial load applied on a container flange results in an axial load applied to the container body sidewall, and is believed to assist in metal flow as the container is expanded outward by a can shaping operation.

The container body may be placed in tooling in a plurality of ways. For example, there can be clearance between the container body and die cavity such that the container is held (e.g. at a container flange end) by a floating second support and/or at the upper end by the die cavity, but not necessarily clamped by the die cavity on its sidewall. Furthermore, if an embodiment uses internal air pressurization of the container body, such pressurization does not necessarily hold the container against the die cavity wall until the container body has expanded to contact the die cavity. Further variations of the die cavity fit interaction include a slight interference fit between the container body wall and cavity internal diameter. For example, the container body sidewall may be clamped by the die cavity surface when the die cavity is in a closed position. Another embodiment of a die cavity fit interaction includes a large interference fit between the container body wall and the cavity internal diameter.

If both the container and cavity are continuous surfaces of revolution, there is preferably only a slight interference fit between the container and cavity or the container will be crushed by the cavity as it closes. Upon internal pressurization of the container body, the container is held in the die cavity, at least partially, by a combination of an interference fit between the die cavity/container and the radial expansion of the container body sidewall from internal pressure in the container. This inhibits the container from rotating in an undesirable manner in a die cavity.

In addition, the cavity may contain a discontinuous profile such as ribs, flutes or embossed letters that may be partially pressed into the container when the cavity closes. These high points on the cavity profile will remain in the container surface after the container is shaped and create a debossment into the container surface while the portions of the container that are expanded outward by the shaping operation will be raised out from the original container surface. In this fashion, an increased degree of local relief can be created in the container with a lower degree of absolute expansion of the container diameter (compared to previous methods). Ribs or other features will also tend to lock the container in the cavity, particularly if pressurized, and prevent the container from rotating. The effective circumferential length of the profile on the cavity should be longer than the circumferential length of the wall in the container preform to decrease the likelihood that the container will be crushed by the cavity when the cavity closes. The degree of debossment into the container wall by the tooling cavity is thus, in at least some circumstances, limited by the circumferential length of the container wall.

Another aspect of an embodiment of a present invention generally relates to container body shaping/reshaping operations utilizing two fluids. One of these fluids is for effectively exerting local reshaping forces on a container body and the other is for effectively "controlling" a container body during the application of these reshaping forces to a container body (e.g., to effectively "control" or "hold" the metal of the drawn and ironed container body while being reshaped).

The container body may be "pre-loaded" (axially loaded) either in a single fluid embodiment or in the above-noted multiple fluid aspect of an embodiment of a present invention. An axially-directed load (e.g., compressive) may be applied to the container body during the exposure of the container body to a pressurized first fluid and/or during the application of reshaping forces to a container body, e.g., by the action of a second fluid on the surface of a container body.

DETAILED DESCRIPTION

Figure 1:
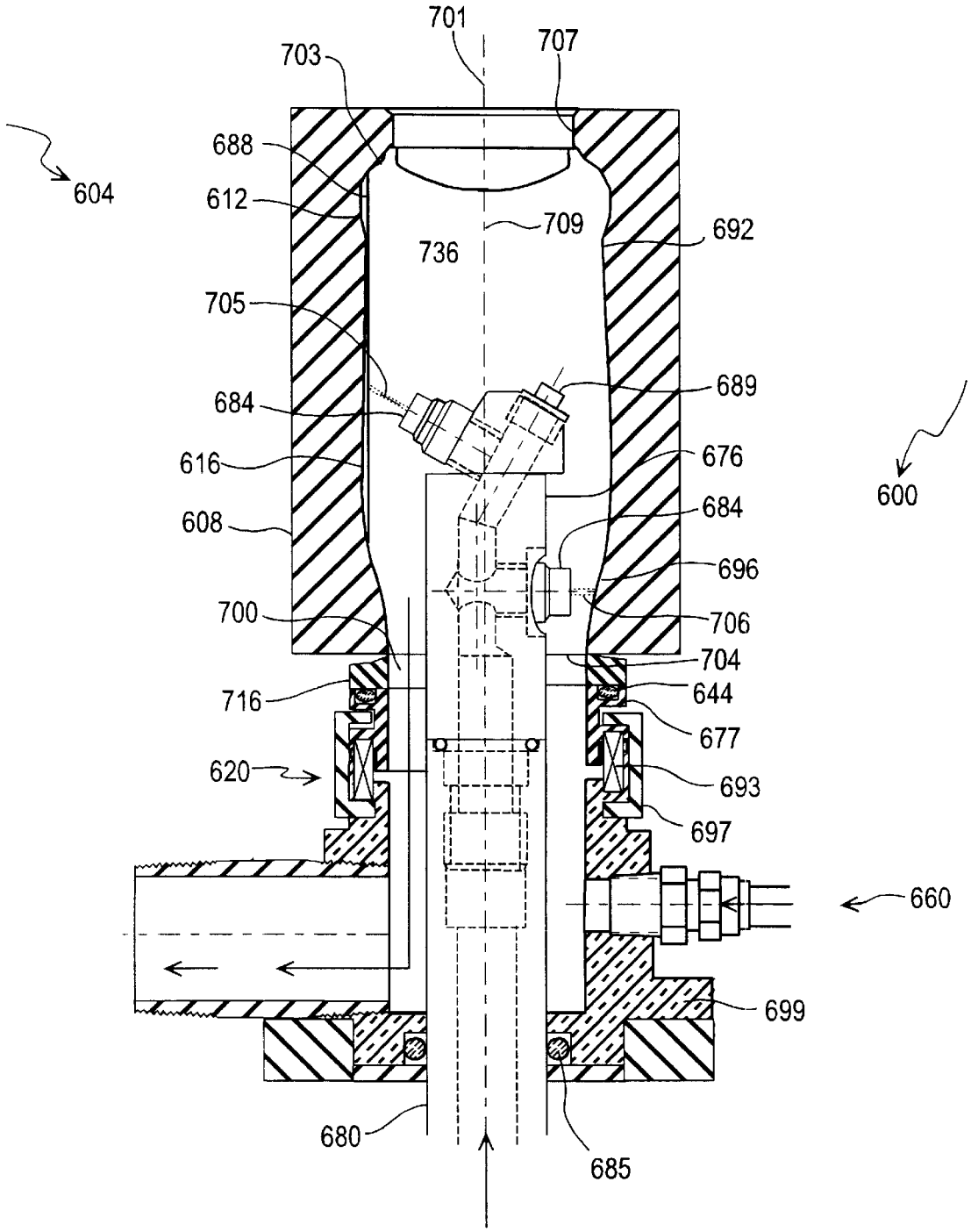
FIG. 1 is a cross-sectional view of an apparatus for container body shaping with flange seal and axial loading, according to an embodiment of a present invention.

According to one embodiment of the present invention, an apparatus/method is provided for shaping and embossing thin-walled work pieces such as container bodies (e.g., having a sidewall thickness of no more than about 0.0070 inch), including in particular, the achievement of complex and non-uniform shapes/designs in the sidewalls of metal containers. An apparatus/method may also provide for shaping and embossing capabilities in a manner which does not require subsequent annealing of container bodies, including in particular cylindrical drawn and ironed, aluminum and steel alloy containers.

For present purposes, a "shaped can" is a thin walled metal container in which the sidewall surface may contain regular surfaces of revolution, bulges, ribs, and flutes; irregular surfaces such as flutes, ribs, embossments, letters, company or other logos, diamonds, faces, geometric renderings of artwork, triangles, textures, bubbles, or fanciful shapes. The possible shapes and surfaces are not limited to the above list and include combinations and permutations of these geometric surfaces.

At least one apparatus/method to be discussed in more detail below employs at least one pressurized fluid stream (e.g., liquid) that is ejected at high velocity directly against a sidewall of a container body to impart the desired shape/design. The word "pressurized" in relation to this fluid stream(s) is directed to a nozzle pressure of the fluid which converts the high pressure into a high velocity. The impact force generated by the fluid mass of the fluid stream(s) and its velocity is what is actually used to modify the shape of a container body (as opposed, e.g to hydrostatic forces of the liquid which are typically non-local in nature and play little if any role in reshaping).

It is important to note that the utilization of a directed fluid stream(s) allows for localized working of metal container body sidewalls to achieve high degrees of metal deformation (e.g., exceeding 15% for current drawn and ironed aluminum container bodies). In particular, by providing relative longitudinal and rotational movement of the fluid stream(s) and container body, localized working may progress, e.g. in a helical fashion about and along a container body.

One or more aspects of one or more of the apparatus/methods to be discussed in more detail below allow for the achievement of complex and non-uniform shapes/designs, including geometric shapes/designs (e.g., diamonds, triangles, company logos, etc.), lettering (e.g., product/company names, etc. in block print, script, etc.) and fanciful shapes/designs having angled and/or arcuate shape-defining edges and/or surfaces that vary around, about and along the longitudinal extent of a container body.

In one embodiment, the container pressurization process may involve pressing a floating seal ring against a container flange. This is particularly useful since the floating seal ring can be configured to maintain an axial load and simultaneously maintain a seal. The axial load can act to seal the interface between the floating seal ring and the container flange.

A plurality of variations of a die cavity fit interaction include a slight to strong interference fit between a container wall and cavity internal diameter. In one embodiment, as a container body is clamped by the die cavity and the container body wall is pushed inward/outward, the summation of the interference fit forces provides greater stress relief of the container body wall. Upon application of internal pressure, the container body will be held with respect to the die cavity by a combination of the interference fit between the die cavity wall and the container body, and the radial expansion of the container sidewall from the internal pressure in the container.

An embodiment of a container body reshaping assembly 600 for shaping a metal container is illustrated in FIG. 1, and includes a generally cylindrical contoured surface 616 which extends axially between an upper region 701 and a bottom region 704. The depicted reshaping assembly 600 contains a die assembly 604, which is configured to include a die 608 with a die cavity 612 having a contoured surface 616 different from a first surface 688 of the container which is at least partially spaced therefrom. The die assembly 604, including having die 608, may be formed in multiple parts for loading/removal of a container body first surface 688 (e.g., the die 608 may be formed in three separate and radially movable die sections).

The die 608 is positioned at least partially adjacent to the container body with a first support 703 contacting a container upper region 701 and a second support 716 contacting a bottom region 704. The first support 703 is positionable with respect to a second support 716 such that at least a first portion of the container sidewall 692 is placed in an axial load. An upper region 701 of the container includes an outwardly-extending flange 707 on a first support, and the second support 716 is mounted so as to be urged in a direction having a component toward the first support 703, providing pressure against a surface of the outwardly-extending flange 707. Thus, the second support 716 is free to move (e.g., "float") so as to follow the movement of the container flange 700 as the container sidewall 692 conforms to the contoured surface 616 of the die 608. Consequently, the second support 716 substantially maintains an axial load on at least a first portion of the container sidewall 692 as the second support 716 moves. When there is an axial load from the second support 716, a fluid seal is formed with respect to the container flange 700 and a fluid seal is substantially maintained as the second support 716 moves. In one embodiment, axial load is from about 5 pounds (about 2 kg) of force, preferably at least about 10 pounds (about 5 kg) of force, to less than about 100 pounds (about 50 kg) of force, preferably less than about 40 pounds (about 20 kg) of force.

The second support 716 interfaces with a spring cap 677 of a seal assembly 620. The spring cap 677 interfaces with a loading spring 693, which interfaces with a chamber 699 of the seal assembly 620. The spring cap 677, loading spring 693, and chamber 699 are secured by a spring retainer 697. An O-ring 644 may be disposed between the second support 716 and spring cap 677 for maintaining a proper seal. Also, an O-ring 685 may be disposed between a spray wand 680 and chamber 699 for maintaining a liquid tight seal.

In the depicted embodiment, reshaping assembly 600 has a spray nozzle 684 positionable inside the interior 736 of the container sidewall 692 for directing a pressurized fluid stream in at least a first direction 705 (and/or in a second direction 706) having a non-axial component, while at least a portion of the container sidewall 692 is in axial load. This is believed to facilitate forming the container sidewall 692 to substantially conform to the contoured surface 616 of the die 608.

The fluid stream is directed against a selected portion of the container body surface 688 to force the portion of the container body sidewall 692 toward the contoured surface 616 of the die assembly 604. By moving the fluid stream, the sidewall 692 is shaped into a predetermined configuration between the pressurized fluid stream 705 and the contoured surface 616, while at least a portion of the sidewall 692 is placed under an axial load while the sidewall 692 is being shaped.

Figure 2:
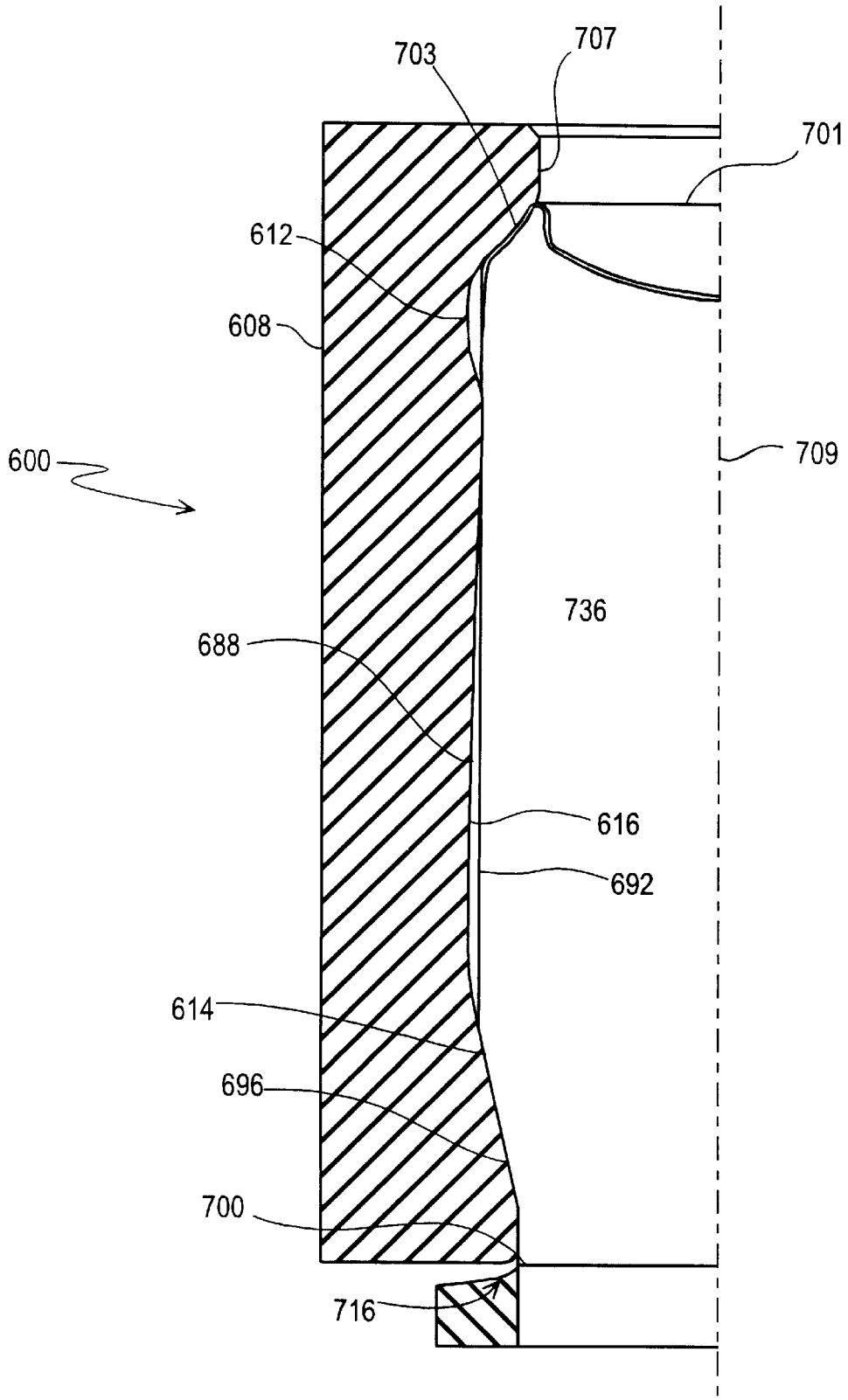
FIG. 2 is a partial cross-sectional view showing clearance between a die cavity and container prior to the shaping process, according to one embodiment of a present invention.
Figure 3:
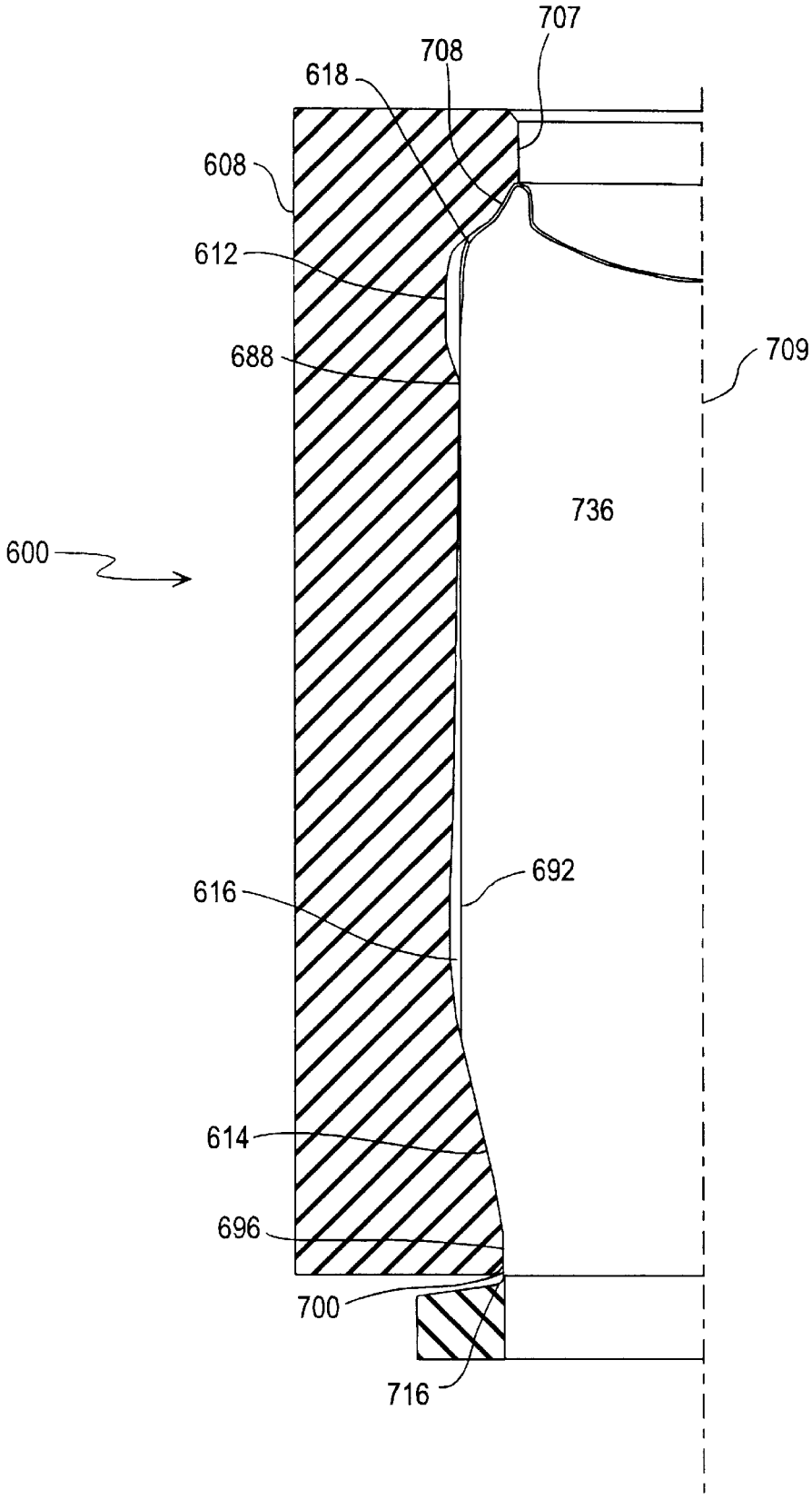
FIG. 3 is a partial cross-sectional view showing a slight interference between a die cavity and a container prior to the shaping process, according to an embodiment of a present invention.
Figure 4:
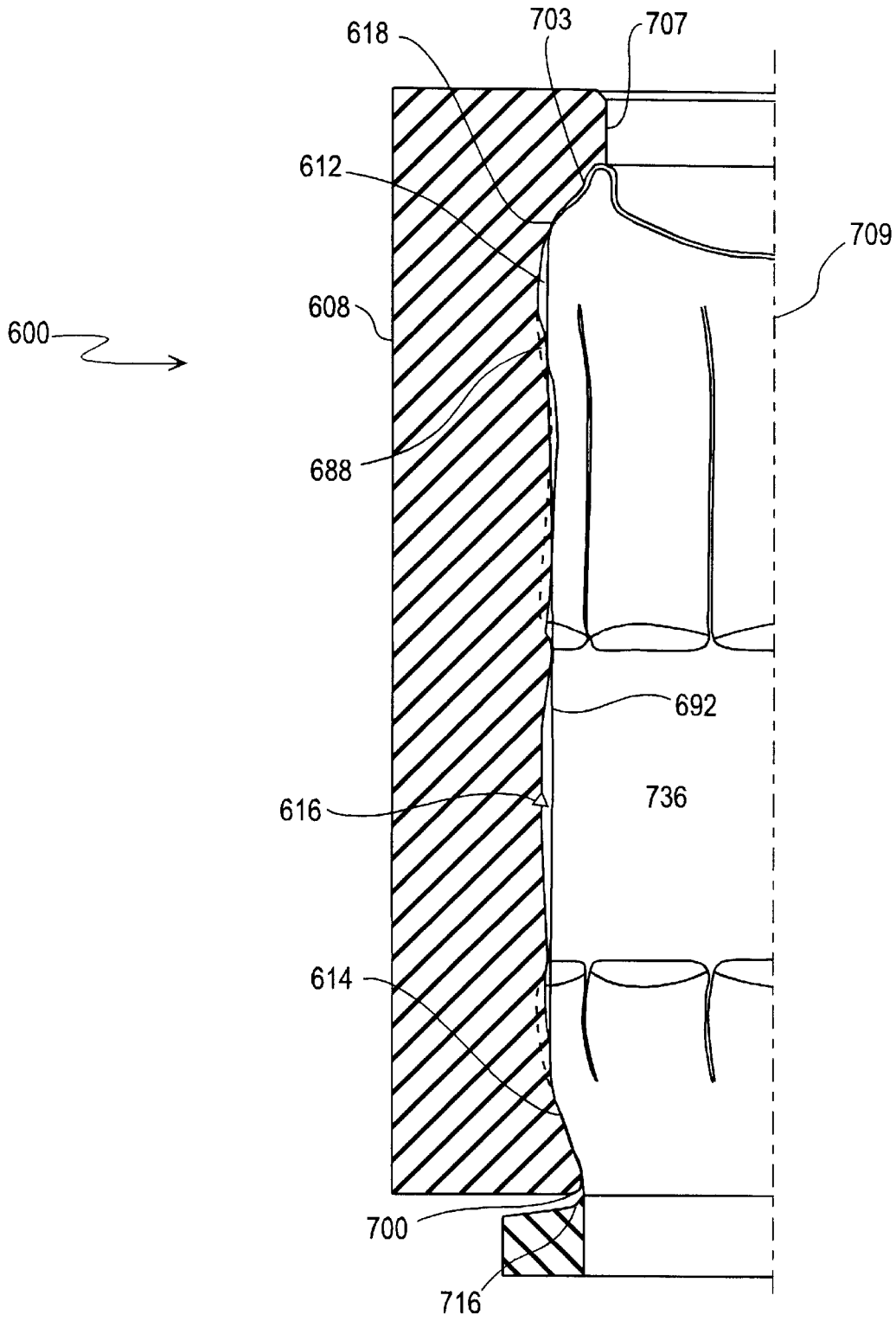
FIG. 4 is a partial cross-sectional view showing an interference fit between a die cavity and a container prior to the shaping process, according to an embodiment of a present invention.

In FIG. 2, the sidewall 692 defines a longitudinal axis 709 of symmetry. The die 608, which is substantially without an interference fit with respect to the sidewall, has an inner contoured surface 616 substantially surrounding at least a portion of the sidewall 692 with the inner contoured surface 616 being different from a first surface 688 of the container sidewall 692. In the embodiment of FIG. 3, at least a first portion of an inner contoured surface 616 of a die 608 extends inwardly a first distance past the sidewall 692 original outer diameter (with the distance being small enough to avoid non-elastic deformation of the sidewall, provide fluid re-shaping) to define a least a slight interference fit between at least a first portion of the inner contoured surface 616 and the sidewall 692. In the embodiment of FIG. 4, the first distance is sufficient to inwardly deform a portion of the container sidewall 692, and, in some cases, to non-elastically deform the container sidewall 692, providing a strong interference fit.

FIG. 4 also illustrates a configuration in which the inner contoured surface 616, is configured such that, after the sidewall is conformed to the die, the sidewall has at least one region which has been deformed a first distance inwardly of the original outer diameter of the container sidewall 692, and at least another region which has been deformed outwardly a second distance of the original outer diameter of the container sidewall 692. In this way, even though sidewall 692 may be formed of a material having an upper limit on the distance the cylindrical container sidewall 692 may be deformed outwardly without failure, the sum of the first distance of deformation and the second distance of deformation may exceed the upper limit.

Figure 5:
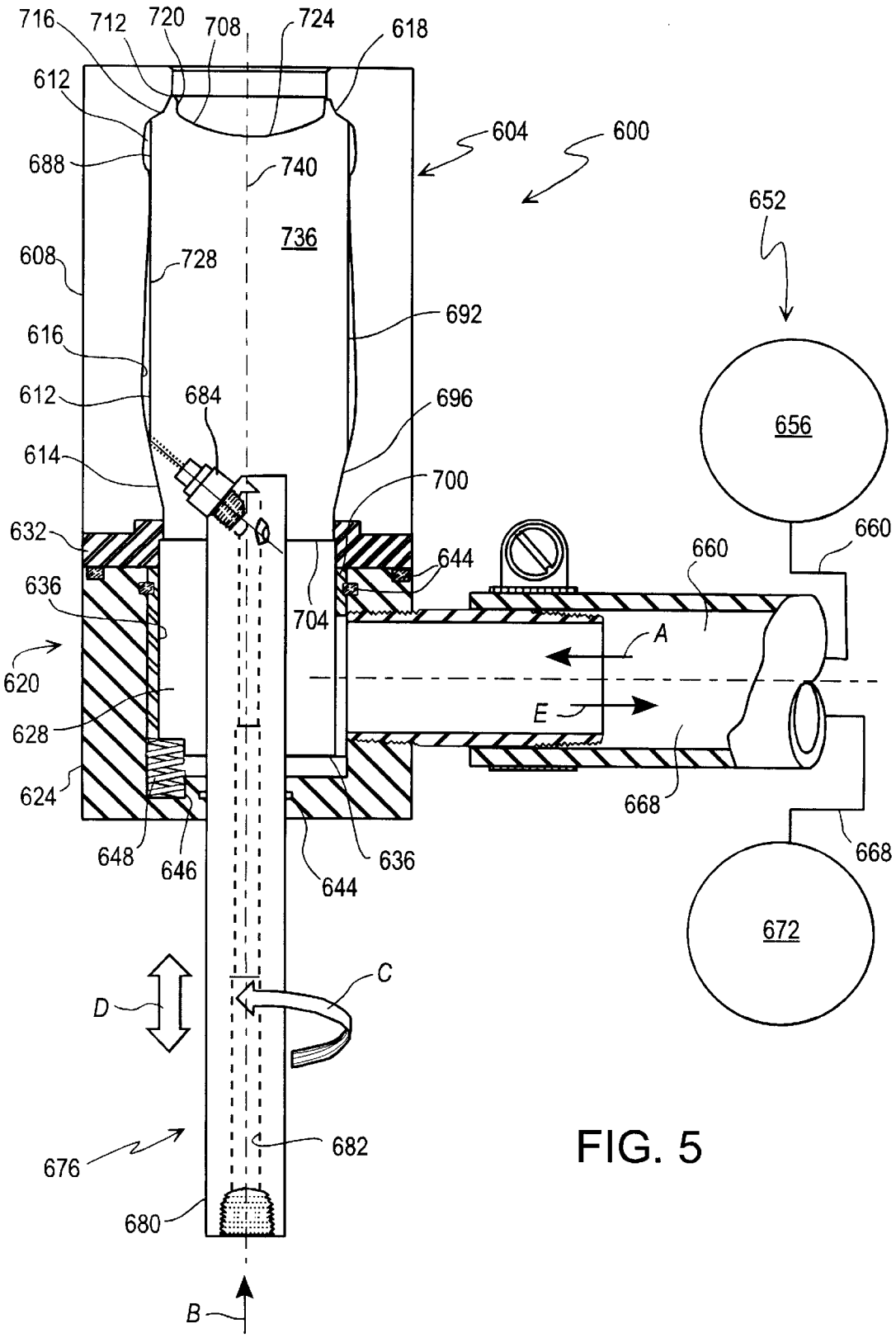
FIG. 5 is a cross-sectional view of a container body reshaping apparatus according to an embodiment of the present invention

In the embodiment of FIG. 5, the mold or die assembly 604 interacts with the seal assembly 620 to allow the container body surface 688 to be pressurized with one fluid (via a pressurization assembly 652) prior to being principally reshaped by another fluid (via a spray assembly 676). In this regard, the lower portion of die 608 includes a neck ring 632 which may be integrally formed with die 608 or separately attached thereto. Various partitions (not shown) may be utilized to allow neck ring 832 to be split, along with die 608, for loading of container body first surface 688 within die assembly 604.

The neck ring 632 interfaces with the seal housing 624 of the seal assembly 620. The seal housing 624 includes a seal housing cavity 628 for introducing the pressurized fluid from pressurization assembly 652 into container body first surface 688 through its open end 704. Various O-rings 644 may be disposed between a neck ring 632 and a seal housing 624 to provide an appropriate seal therebetween during use of the pressurization assembly 652.

The neck ring 632 of the die assembly 604 also conformingly interfaces with and supports an upper portion of a neck 696 and flange 700 of container body first surface 688. The flange 700 of container body first surface 688 is retained between split neck ring 632 and a generally cylindrical inner seal 636 which is disposed inside the seal housing 624. One or more springs 648 (one shown) is seated within an appropriately shaped spring cavity 646 within a seal housing 624 and biases the inner seal 636 against a flange 700 of the container body surface 688 to forcibly retain the flange 700 between the neck ring 632 and the inner seal 636. This effectively seals the interior 736 of the container during use of the pressurization assembly 652. In one embodiment, the spring 648 applies a force ranging from about 10 to about 50 pounds on flange 700 to retain the same between the inner seal 636 and the neck ring 632. This may also bias the container body first surface 688 against a nose seat 618 of the die 608 to axially pre-load the container body sidewall.

Pressurization assembly 652 pressurizes the interior 736 of the container body or exposes certain portions of the container body first surface 688 to a pressurized fluid, to "hold" or "control" the metal during reforming of the container body first surface 688 with a spray assembly 676. Operational pressures used by the pressure assembly 652 are substantially less than those used by the spray assembly 676 (e.g., ranging from about 0.5% to about 6% of the pressures used by the spray assembly 652), such that the pressure assembly 652 may be referred to as using a low pressure fluid and the spray assembly 676 may be referred to as using a high pressure, high velocity fluid. The pressurization assembly 652 may also be characterized as functioning to improve the formability of the container body through use of the spray assembly 676, to reduce the potential for "spring-back" of the container body first surface 688 after it is reformed, to potentially allow for a reduction in the pressure used by a spray assembly 676 in comparison with the above-discussed embodiments, to improve upon the surface finish of a container body first surface 688 after reformation, and/or to reduce the number of passes required by a spray assembly 676 in comparison with the above-discussed embodiments.

The pressurization assembly 652 includes a pressure source 656 (e.g,. a compressor) which contains an appropriate fluid and which is fluidly interconnected with the sealing cavity 628, and thereby the interior 736 of the container body, by a pressure line 660. This pressure line 660 extends through seal housing 624 and through an appropriate opening in the inner seal 636, and flow is in the direction of the arrow A. Preferably, the fluid used by a pressurization assembly 652 is a gas, and is more preferably air. In one embodiment, the pressurization assembly 652 introduces a fluid (e.g., a gas such as air) into the interior 736 of the container body to expose substantially the entirety of the interior surface 728 of the container body to a fluid pressure (e.g., air pressure) which is preferably substantially spatially uniform, which will create a tensile hoop stress in the container wall, and which is within the range of about 10% to about 50% of the yield strength of a container body first surface 688. In one embodiment, the pressure within the interior 736 of the container body is substantially constant and within the range of about 20 psi to about 100 psi, preferably within the range of about 30 psi to about 60 psi, and more preferably no greater than about 40 psi. The pressure within the interior 736 may also increase in a controlled manner during the reshaping process or use of a spray assembly 676. During introduction of fluids into the interior 736 of the container body by a spray assembly 676, the pressure within the interior 736 will increase above that provided by a pressurization assembly 652. A pressure relief valve may be utilized to limit the pressure rise to a predetermined value (e.g., within the noted ranges or less than 100 psi). Throughout at least a substantial portion of, and typically throughout the entire, operation of a spray assembly 676 when reforming a container body preferably the pressure within the interior 736 of the container body is maintained at a substantially constant value by the pressurization assembly 652. As such, the fluid pressure provided by the pressurization assembly 652 may be characterized as being substantially static during the reshaping process.

The spray assembly 676 generates and applies the primary reshaping force to local regions of an interior surface 728 of the container body first surface 688. Generally, the spray assembly 676 includes a spray wand 680 which extends through the lower portion of a seal housing 624 and into the interior 736 of a container body first surface 688, and which has at least one spray nozzle 684.

An appropriate fluid, preferably a liquid such as water, is directed up through an interior conduit 682 of the wand 680 in the direction of the arrow B and out each spray nozzle(s) 684 to exert a local reshaping force on a portion of the interior surface 728 of the container body. This then forces the impacted portion of the container body first surface 688 radially outwardly into substantial conforming engagement with a corresponding portion of the contoured surface 616 of the die 608. Relative rotation and longitudinal movement between the spray assembly 676 and the container body first surface 688 allows spray nozzle(s) 684, over time, to direct fluid against substantially the entire interior surface 728 of container body sidewall 692 of a container body (e.g., by rotating a spray wand 680 about a center of rotation corresponding with the central, longitudinal axis 740 of the container body in the direction of the arrow C, and simultaneously axially advancing the spray wand 680 into and out of the interior 736 of the container body in the direction of the arrow D at least once, and typically a plurality of times).

Fluid discharged from the spray nozzle(s) 684 impacts a relatively small portion of the interior surface of the container body with a concentrated force. There are a number of contributing factors. Initially, in one embodiment each spray nozzle 684 is spaced from the interior surface of the sidewall 692 a distance within the range of about ⅛" to about ¾", and more preferably within the range of about ¼" to about ½". Fluid (e.g. water) from the spray assembly 676 thereby travels through the fluid (e.g. air) from the pressurization assembly 652, which is also within the interior 736 of the container body to impact the container body first surface 688 to reform the same.

Another factor which contributes to the application of a concentrated, local force on the container body is that the fluid discharged from each spray nozzle(s) 684 (e.g., water) and onto a container body first surface 688 is in the form of a high velocity fluid stream. This fluid stream in one embodiment has a width ranging from about 0.040 inches to about 0.150 inches when it impacts the interior surface 728 of the container body and the area of the container body first surface 688 impacted by each fluid stream at any point in time may range from about 0.0015 $in^2$ to about 0.050 $in^2$. The pressure acting on the interior surface 728 of the container body first surface 688, where impacted by the fluid stream, in one embodiment ranges from about 1,000 psi to about 5,000 psi. A lower pressure requirement for the spray force to reshape the metal can be achieved by use of internal (air) pressurization in the can, which will produce a tensile hoop stress in the can wall.

Fluid from the spray assembly 676 is removed from the interior of the container by a drain assembly 664, specifically after the fluid has impacted the interior surface 728 of the container body. A drain line 668 extends through the seal housing 624 and fluidly interconnects the seal housing cavity 628 and a drain tank 672. The drain line 668 may be disposed adjacent to the pressure line 660. The drain tank 672 may be pressurized, such as at about 45 psi. Fluid from the spray assembly 676 thereby falls into the seal housing cavity 628 and flows through the drain line 668 in the direction of the arrow E to the drain tank 672.

Reshaping operations with a reshaping assembly 600 will now be summarized. In loading a container body into the die 608, the die 608 is opened (i.e., radially separated into at least two, and preferably three different parts), and the die assembly 604 and seal housing 624 are axially separated or spaced. Thereafter the die 608 may be closed and the seal housing 624 may move into engagement with the die assembly 608. This subjects the container body to an axially-compressive force to pre-load the container body first surface 688 as noted above. Moreover, this also seals the interior 736 of the container body first surface 688 for activation of the pressurization assembly 652. Specifically, a flange 700 of the container body first surface 688 is forcibly retained between the neck ring 632 of the die assembly 604 and the inner seal 636 of seal assembly 620 by the action of spring(s) 648 to effectively allow the interior 736 of the container body to be pressurized.

The pressurization assembly 652 is activated to introduce fluid (e.g., air) into the seal housing cavity 628 and then the interior 736 of the container body. The gas fluid pressure within the interior 736 of the container body first surface 688 is comparatively low in relation to the spray pressure from the spray assembly 676, and is typically insufficient to cause the container body sidewall to fully conform to the contoured surface 616 of the die 608. This further effectively functions to "hold" or "control" those portions of a container body first surface 688 which are impacted by the fluid stream from spray nozzles 684 of one spray assembly 676. The fluid stream from the spray nozzle 684 only acts upon a small portion of the interior surface 728 of a container body first surface 688 at any given time. The spray wand 680 is rotated along an axis which coincides with the central, longitudinal axis 740 of the container body first surface 688 and is axially advanced and retracted within the interior 736 of the container body to reshape the same (an inward extension and subsequent retraction of a wand 680 comprising a stroke, and multiple strokes may be utilized). Fluids from a spray assembly 676 are removed from the interior 736 of the container body via drain line 668.

The foregoing description of the present invention has been presented for purposes of illustration and description. The description is not intended to limit the invention to the form disclosed herein. Consequently, variations and modifications commensurate with the above teachings, and skill and knowledge of the relevant art, are within the scope of the present invention. The embodiments described hereinabove are further intended to explain best modes known of practicing the invention and to enable others skilled in the art to utilize the invention in such, or other embodiments and with various modifications required by the particular application (s) or use(s) of the present invention. It is intended that the appended claims be construed to include alternative embodiments to the extent permitted by the prior art.

What is claimed is:

1. An apparatus for shaping a metal container, the container including a thin, generally cylindrical wall extending axially between a bottom region and an upper region, the apparatus comprising:

a die having a contour different from a first surface of said container wall and at least partially spaced therefrom;

first and second supports for contacting at least portions of said container bottom region and upper region, respectively, said first and second supports positionable, with respect to one another, to place at least a first portion of said container wall in axial load; and a nozzle positioned to direct a pressurized fluid stream in at least a first direction having a non-axial component, against at least a portion of a second opposite surface of said container wall, while said first portion of said container wall is in axial load, wherein at least a portion of said container wall is substantially conformed to said die contour.

2. An apparatus as claimed in claim 1, wherein said upper region of said container includes an outwardly-extending flange and wherein said second support is mounted so as to be urged in a direction having a component toward said first support, providing pressure against a surface of said flange.

3. An apparatus as claimed in claim 2, wherein said second support is free to move so as to follow a movement of said flange as said container wall is conformed to said die contour.

4. An apparatus as claimed in claim 3, wherein said second support substantially maintains an axial load on at least said first portion of said container wall as said second support moves.

5. An apparatus as claimed in claim 3, wherein said second support forms a fluid seal with respect to said flange, and wherein said fluid seal is substantially maintained as said second support moves.

6. An apparatus as claimed in claim 1, wherein said axial load is at least about 5 pounds force.

7. An apparatus as claimed in claim 1, wherein said axial load is at least 10 pounds force.

8. An apparatus as claimed in claim 1, wherein said axial load is less than about 100 pounds force.

9. A metal container shaping apparatus comprising:

a shape-defining means having at least one contoured surface positionable adjacent to a metal container body, said metal container body defining a longitudinal axis;

means for directing a pressurized fluid stream in at least a first direction having a non-axial component, against a selected portion of a container body to force said container body portion toward said contoured surface of said shape-defining means, wherein said container body portion is shaped into a predetermined configuration between said pressurized fluid stream and said configured surface;

means for placing at least said selected portion of said container body under axial load while said container body portion is shaped.

10. An apparatus as claimed in claim 9, wherein an upper region of said container includes an outwardly-extending flange and wherein said means for placing said selected portion under axial load includes a flange contact surface and means for providing pressure of said flange contact surface against a surface of said flange.

11. An apparatus as claimed in claim 9, wherein an upper region of said container includes an outwardly-extending flange further comprising means for maintaining a substantially liquid-tight seal with respect to said flange while said body portion is shaped.

12. A method for making a container, comprising the steps of:

forming a container body having a generally cylindrical sidewall defining a longitudinal axis;

axially compressing at least a first portion of said cylindrical sidewall;

directing at least one fluid stream in a direction having a non-axial component, directly against a discrete portion of said container body; and changing a shape of said discrete portion of said container body using said directing step.

13. An apparatus for shaping a metal container, the container including a thin, generally cylindrical wall having a diameter, the apparatus comprising:

a die having an inner surface adjacent at least a portion of said cylindrical wall, said inner surface having a contour different from a first surface of said container wall;

said diameter being such that there is at least a first clearance between said cylindrical wall and said inner surface of said die;

a nozzle positioned to direct a pressurized fluid stream against at least a portion of said container wall, to substantially conform at least a portion of said container wall to said contour of said inner wall of said die.

14. An apparatus for shaping a metal container, the container including a thin, generally cylindrical wall having an outer diameter and defining a longitudinal axis of symmetry of said cylindrical wall, the apparatus comprising:

a die having an inner surface substantially surrounding at least a portion of said cylindrical wall, said inner surface having a contour different from a first surface of said container wall;

at least a first portion of said inner surface of said die extending inwardly a first distance past said cylindrical wall outer diameter to define an interference fit between at least said first portion of said inner surface of said die and said container cylindrical wall; and a nozzle positioned to direct a pressurized fluid stream against at least a portion of said container wall, to substantially conform at least a portion of said container wall to said contour of said inner wall of said die.

15. An apparatus as claimed in claim 14, wherein said first distance is sufficient to inwardly deform said cylindrical wall.

16. An apparatus as claimed in claim 14, wherein said first distance is sufficient to non-elastically deform said cylindrical wall.

17. An apparatus as claimed in claim 14, wherein an axial region of said inner surface which contains said first portion of said inner surface defines a surface of revolution about said longitudinal axis.

18. An apparatus as claimed in claim 14, wherein an axial region of said inner surface which contains said first portion is radially non-symmetric about said longitudinal axis.

19. An apparatus as claimed in claim 14, wherein each circumferential distance of said inner surface of said die is greater than a substantially adjacent circumference of said cylindrical wall.

20. An apparatus as claimed in claim 14, wherein after at least said portion of said container wall is substantially conformed to said contour of said inner wall of said die, said container wall has at least one region which has been deformed a first distance inwardly of said outer diameter and at least another region which has been deformed outwardly a second distance of said outer diameter.

21. An apparatus as claimed in claim 20, wherein said container is formed of a material having an upper limit on the distance said cylindrical sidewall may be deformed outwardly without failure, and wherein the sum of said first distance and said second distance exceeds said upper limit.

22. An apparatus for shaping a metal container, said container having a substantially cylindrical sidewall with an outer surface and an inner surface, the apparatus comprising:

a shape-defining means having a contoured surface positionable around and spaced from said sidewall outer surface; and means for directing a pressurized fluid stream against a selected portion of said sidewall inner surface to force said container body portion outward toward said contoured surface of said shape-defining means, wherein said container body portion is shaped into a predetermined configuration between said pressurized fluid stream and said contoured surface.

23. An apparatus for shaping a metal container, said container having a substantially cylindrical sidewall with an inner surface and an outer surface, said outer surface defining s sidewall diameter, the apparatus comprising:

a shape-defining means having a configured surface and positionable with respect to said sidewall of said container such that a first portion of said contoured surface extends inwardly past said sidewall diameter to provide an interference fit therewith; and means for directing a pressurized fluid stream against a selected portion of said sidewall inner surface to force at least said selected portion of said container body outward toward at least a second portion of said configured surface of said shape-defining means, wherein said container body portion is shaped into a predetermined configuration between said pressurized fluid stream and said contoured surface.

24. A method for shaping a metal container, said container having a substantially cylindrical sidewall with an outer surface and an inner surface, the method comprising:

positioning said container within a die having a contoured surface positionable around and spaced from said sidewall outer surface; and directing a pressurized fluid stream against a selected portion of said sidewall inner surface to force said container body portion outward toward said contoured surface of said die, wherein said container sidewall is shaped into a predetermined configuration between said pressurized fluid stream and said configured surface.

25. A method for making a container, comprising the steps of:

forming a container having a substantially cylindrical sidewall with an inner surface and an outer surface defining a sidewall diameter;

positioning said container within a die having a contoured surface such that a first portion of said contoured surface extends inwardly past said sidewall diameter to provide an interference fit therewith; and directing at least one fluid stream against a selected portion of said sidewall inner surface to force at least said selected portion of said container body outward toward at least a second portion of said contoured surface of said die, wherein said container sidewall is shaped into a predetermined configuration between said fluid stream and said contoured surface.

* * * * *